United States Patent [19]

Stearns et al.

[11] Patent Number: 5,072,928

[45] **Date of Patent: * Dec. 17, 1991**

[54] TREADMILL

[75] Inventors: Kenneth W. Stearns; John K. McGee, both of Houston, Tex.

[73] Assignee: Stearns McGee Incorporated, Houston, Tex.

[ * ] Notice: The portion of the term of this patent subsequent to Jan. 15, 2008 has been disclaimed.

[21] Appl. No.: 345,631

[22] Filed: May 1, 1989

Related U.S. Application Data

[63] Continuation-in-part of Ser. No. 125,112, Nov. 25, 1987, abandoned.

[51] Int. Cl.[5] ..... A63B 22/02

[52] U.S. Cl. ..... 272/69; 272/70

[58] Field of Search ..... 272/69, 70, 70 A

[56] References Cited

U.S. PATENT DOCUMENTS 4,984,810 1/1991 Stearns et al. ..... 272/69

FOREIGN PATENT DOCUMENTS 644774 7/1962 Canada ..... 272/66

OTHER PUBLICATIONS

Catalog—"A Brief Look at Airpot", Airpot Corp., copyright 1982.

*Primary Examiner*—Richard J. Apley
*Assistant Examiner*—D. F. Crosby
*Attorney, Agent, or Firm*—Dodge, Bush, Moseley & Riddle

[57] ABSTRACT

A treadmill is disclosed having a belt system carried by a platform structure. The platform structure is pivotally mounted at its rear end to a base structure. The platform is supported at its forward end by a spring and a shock absorber which provides a damped resilient response of the belt and platform when a runner's foot lands during running or walking. The shock absorber is of the type which resists movement when the platform is moving in the downward direction, but offers relatively little resistance to upward movement of the platform when the spring returns the platform to a rest position during the time the runner is above the platform and is not forcing the platform down. An auxiliary shock absorber is mounted to damp the response of the platform over a short distance as the platform returns to its rest position.

7 Claims, 5 Drawing Sheets

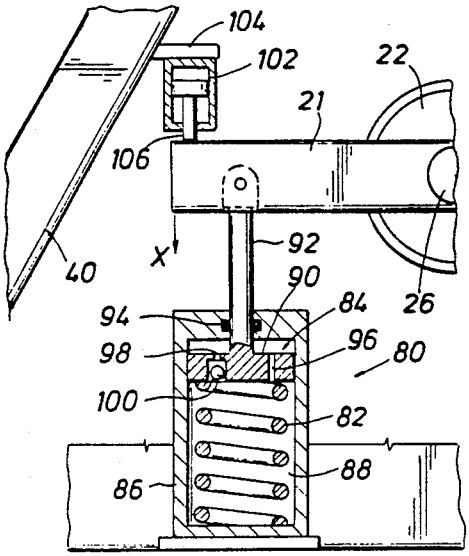
FIG. 5A
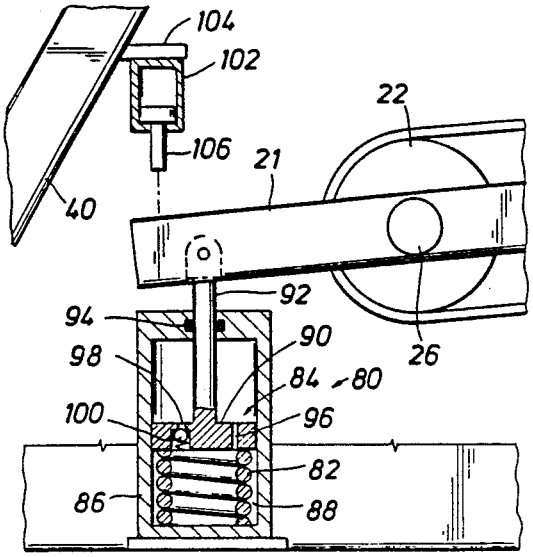
FIG. 5B
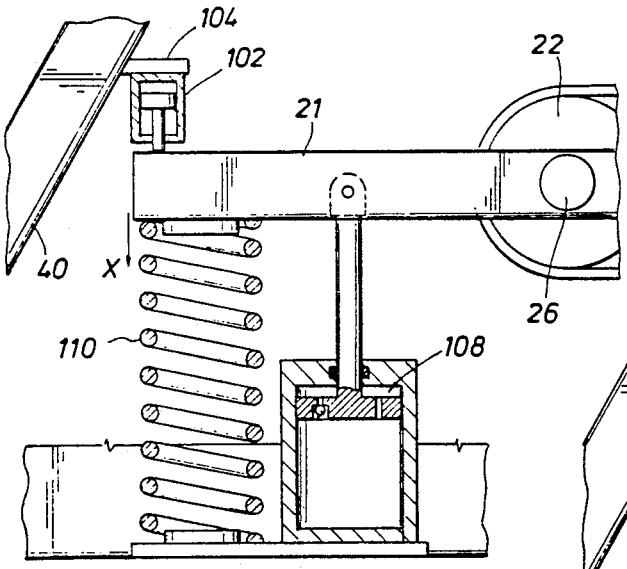
FIG. 6
FIG. 7
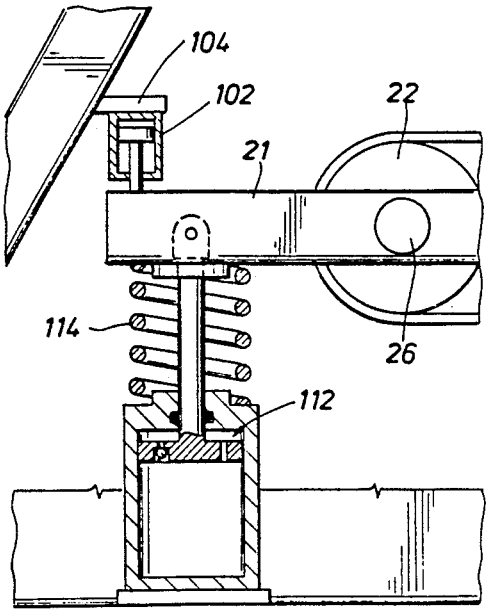

DISTANCE ABOVE SURFACE
LEFT FOOT
RIGHT FOOT
A
B
C
E
A
B
TIME

FOOT STRIKES
DISTANCE BELOW REST POSITION OF PLATFORM
LEFT FOOT
RIGHT FOOT
UPPER POSITION OF PLATFORM ON FOOT IMPACT
D
TIME
A
B
C
E
A
LOWER POSITION OF PLATFORM AS RUNNER LEAPS

ACCELERATION OF MASS OF PLATFORM (FORCE)
TIME

OPPOSING FORCE OF DAMPER ON DOWN STROKE
TIME

SPRING STORED ENERGY
A
B
C
E
TIME

TREADMILL

CROSS-REFERENCE TO RELATED APPLICATION

This application is a continuation-in-part application of parent application Ser. No. 125,112 filed Nov. 25, 1987, now abandoned.

BACKGROUND OF THE INVENTION

1. Field of the Invention

This invention relates in general to treadmills and in particular to an improved shock absorbing treadmill which provides in use reduced landing forces to a runner's foot while simultaneously providing a substantially flat, stable running surface.

2. Description of the Prior Art

The art has provided treadmills in response to demand of walkers, joggers and runners and the medical profession for a device which may be used, especially indoors, for exercise where outdoor walking, jogging or running is not enjoyable or practical. A problem with running or jogging as an exercise to strengthen the cardiovascular system relates to the possibility of impact injury to feet, ankles and knees caused by the force of the runner's foot striking an unyielding surface, such as street pavement. Prior treadmill designs have recognized this problem and have attempted to solve it in a number of ways. For example, U.S. Pat. No. 4,614,337 of Schomenberger discloses a treadmill with a flat top surface covered with a resilient surface such as foam rubber, carpeting or the like. Another example is U.S. Pat. No. 4,548,405 to Lee et al which discloses a trampoline like top surface for a treadmill.

U.S. Pat. No. 4,350,336 to Hanford provides a treadmill having a frame to which rollers are attached which carry an endless tread belt. The belt moves above a platform disposed beneath the running portion of the belt. The platform is supported by longitudinal platform rails which are supported at one end by a lateral frame member which is secured to the frame. The platform is supported at its other end by shock absorbing members attached to the longitudinal rails. The shock absorbing member may be moved longitudinally with respect to the frame. The shock absorbing member absorbs shock directly of the platform as a runner exercises on the treadmill belt above. The platform flexes longitudinally as it pivots at one end and is shock absorbingly supported at its other end.

Although an admirable improvement in the art of shock absorbing treadmills, the Hanford treadmill does not provide an adequately stable running surface. The platform is shock absorbingly supported, but the endless tread belt is not. The belt rollers are both supported directly by the frame. As a result, the belt runs over the platform with sufficient slack in it to allow the platform beneath it to move downwardly in response to the impact of a runner's foot. The slack in the belt can cause an uneven lateral surface for succeeding foot landings, possibly leading to twisted ankles, knees, etc.

IDENTIFICATION OF OBJECTS OF THE INVENTION

It is therefore an object of the invention to provide a stable flat running surface for a treadmill having a shock absorbing means to cushion the impact of a runner's foot.

It is another object of the invention to provide a treadmill having an endless belt which is firmly supported by a platform, and yet the platform and the endless belt and its drive means are shock absorbingly supported.

It is another object of the invention to provide a treadmill having spring and shock absorber devices which produce a damped response to a runner's foot on impact on a belt support platform and provides a rapid return of the platform to its rest position during the time the runner is in the air between impacts.

SUMMARY OF THE INVENTION

The objects identified above, as well as other advantages and features of the invention are provided in an exercise treadmill which includes a belt system including forward and rear rollers and an endless belt placed about such rollers. The belt has an upwardly exposed operative section adapted for running or walking. A belt support platform structure having forward and rear ends provides support for the belt system. The platform structure partially underlies the operative section of the belt and carries the forward roller of the belt system. The rear end of the platform structure is pivotally supported to a base structure near its rear end. The rear roller of the belt system is mounted near the rear end of the platform such that it is free to rotate with the movement of the endless belt. The mounting of the rear roller is preferably to the base structure, but alternatively, may be carried by the platform structure near its end. The platform structure is supported at its forward end by a shock absorber/spring system, preferably linked to the base structure, or alternatively, simply to the ground or floor on which the treadmill is placed. The shock absorber/spring support of the platform structure reduces impact forces on a runner's foot. Such impact force reduction is a result of the downward movement of the platform after the runner's foot strikes the belt above the platform. The platform's downward movement, opposed by the spring(s) of the system, is dampened by the shock absorber(s) of the system. As the runner strides to take another step, the platform and the belt system carried by it, returns to a non-loaded position. Because of the close proximity of the operative section of the endless belt to the platform, there is no slack or sagging of the belt which could cause a runner's foot, ankle or leg to twist upon landing of his foot on the belt.

The system is provided with one or more springs which store the kinetic energy imparted by the runner's foot impacting the belt and platform. One or more shock absorbers or dampers are provided to resist downward movement of the platform. As a result, while the runner's foot remains on the platform, the platform moves downward with a damped response. When the runner in the air between impacts, the downward force on the platform is removed, and the energy stored in the spring forces the platform in an upward direction, rapidly returning it to its rest position. The shock absorber which resisted downward movement provides only an insignificant amount of resistance to such upward movement. An auxilliary shock absorber is provided to slow the platform to its rest position during its last approximately one-half inch of upward travel.

BRIEF DESCRIPTION OF THE DRAWINGS

The objects, advantages and features of the invention will become more apparent by reference to the drawings which are appended hereto and wherein like numerals indicate like parts and wherein an illustrative embodiment of the invention is shown, of which:

FIGS. 5A and 5B schematically illustrate an integral shock absorber and spring supporting the front end of the belt platform structure where the primary shock absorber resists downward movement of the platform and the spring stores energy due to the impact of a runner's foot while running on the treadmill and returns the platform to its rest position when the runner is in the air between impacts above the platform. An auxilliary shock absorber is illustrated which serves to dampen the return of the platform as it nears its rest position;

FIG. 6 is a schematic illustration similar to that of FIG. 5A but shows a substantially uni-directional shock absorber or damper in combination with an external spring for providing a damped downward response of the platform of the treadmill;

FIG. 7 is similar to the illustration of FIGS. 5A and 6 but shows a shock absorber or damper with a spring disposed about a piston rod of the shock absorber and is positioned between the platform and the top of the cylindrical case of the shock absorber;

DESCRIPTION OF THE INVENTION

Figure 1:
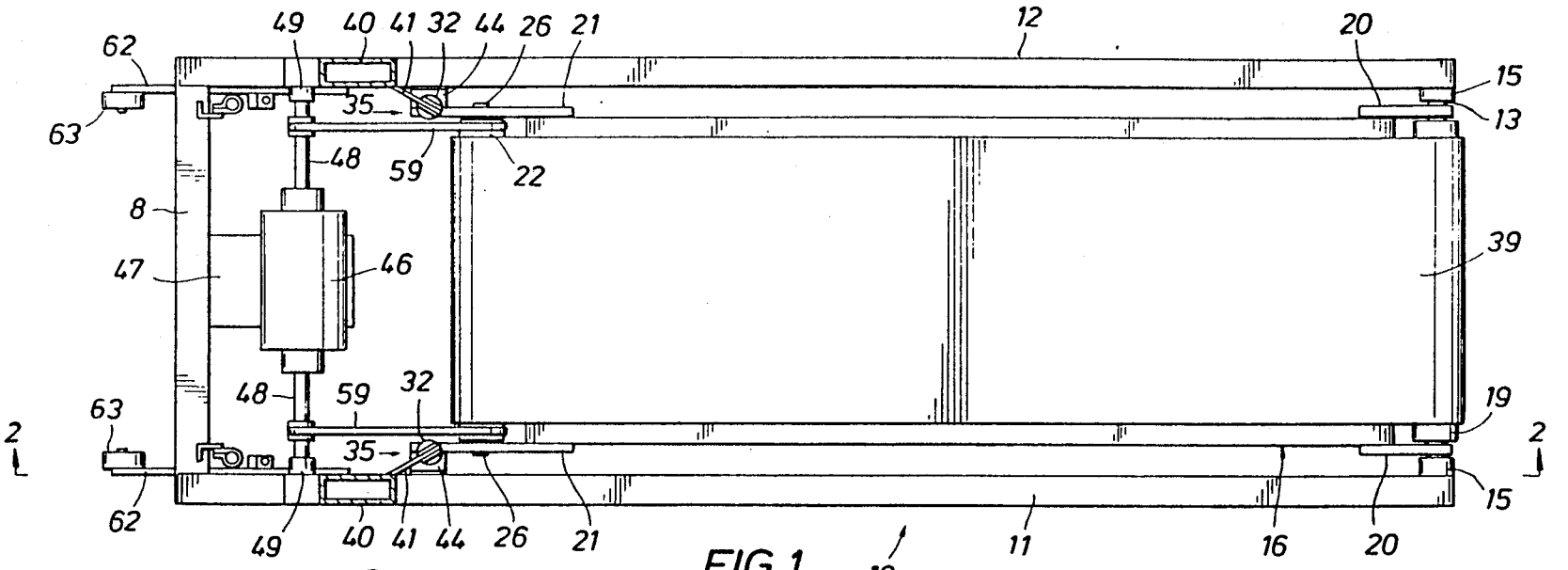
FIG. 1 is a plan view of a treadmill according to the invention which incorporates a shock absorber/spring system.
Figure 2:
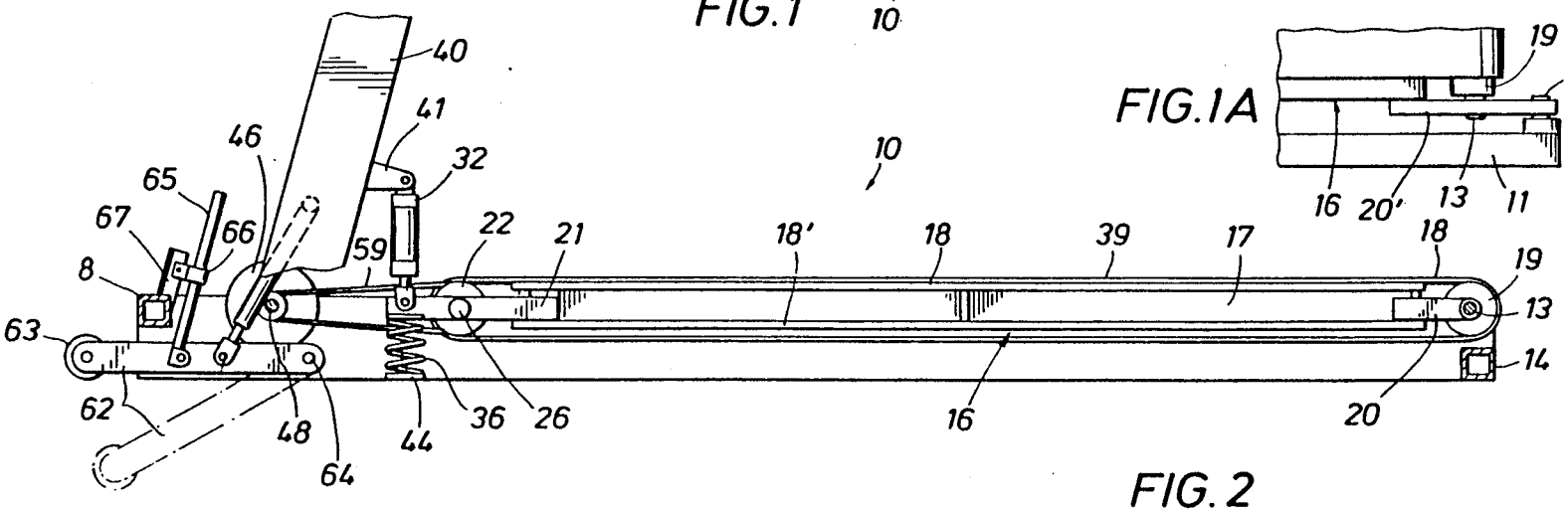
FIG. 2 is a sectional view taken along lines 2—2 of FIG. 1 which further illustrates details of construction of the treadmill with a shock absorber/spring system.

The treadmill 10 of FIGS. 1 and 2 includes a support base having a pair of spaced longitudinal rails 11 and 12. The rails 11 and 12 extend the full length of the apparatus. They are normally placed horizontally on the floor although one end of them may be elevated as will be described below. The rails 11 and 12 are joined by cross support members 8 and 14 and others as appropriate.

The longitudinal rails 11, 12 have a pair of inwardly directed shaft bearing members 15 in which ends of shaft 13 are placed and are free to turn. Rear connection members 20, pivotally connected to shaft 13, are rigidly connected to side members 17 of platform structure 16. Rear roller 19 is disposed about shaft 13 and rotates with it with respect to the base.

The platform structure 16 is generally rectangular in shape, constructed of lightweight material, and preferably includes a pair of longitudinal reinforcing side members 17 and rectangular upper and lower decking members 18, 18'.

Forward connection members 21, rigidly connected to side members 17 of platform structure 16, carry a shaft 26 of which forward roller 22 is connected. Roller 22 and shaft 26 are free to rotate with respect to connection members 21 and platform structure 16.

An endless belt 39 is placed about rollers 22 and 19 and has sufficient longitudinal tension to create negligible vertical slack between the longitudinally spaced rollers. The underside of belt 39 is constructed to pass or slide freely over the upper side of upper decking member 18.

The platform structure 16, and treadmill system (including rollers 22 and 19 and belt 39) are resiliently supported at its forward end by shock absorber/spring system 35 shown in the plan view of FIG. 1. FIG. 2 shows the construction of such system 35 as included on both lateral sides spring 36 secured at its top end to forward connection member 21 and at its bottom end to longitudinal rails 11 and 12 by means of plates 44. The base, including rails 11, 12 are of course placed on the ground or floor. Shock absorbers or dampers 32 are connected between forward connection members 21 and vertical members 40, which in turn are connected to support base longitudinal rails 11. Links 41 connect shock absorbers 32 to vertical members 40. Vertical members 40 may also support a control panel, hand rails and the like (not illustrated).

Shock absorbers or dampers 32 introduce a frictional constraint K proportional to the velocity of the mass that is free to move vertically; in this case, the vertically movable part is the platform structure 16, and at least part of the belt system (belt 39 and roller 22). The platform structure 16 pivots about rear shaft 13. The shock absorber 32 in the preferred embodiment of the invention is constructed to offer no resistance to downward movement of structure 16 for the first one-half inch of travel and to introduce frictional constraint proportional to velocity thereafter.

A motor 46 is supported from cross support member 8 by bracket 47 and includes two coaxial output shafts 48 journaled in bearings 49 secured to support base longitudinal rails 11 and 12. Belts 59 are placed about sheaves on motor output shafts 48 and on forward roller shaft 26 to drive roller 22 and endless belt 39.

The forward end of treadmill 10 may be elevated by pivot legs 62 which may be pivoted about pins 64 to cause the support base to be horizontal with the ground or floor or cause the forward end to be raised. The phantom line illustration of pivot leg 62 illustrates that it can be pivoted downwardly with respect to point 64, thereby raising the forward end of the treadmill, causing the user of it to be running, walking, etc. on an upward grade. Support rods 65, attached to pivot leg 62, may be clamped by clamp 66 at different positions. Clamp 66 is connected to cross support member 8 by links 67. Accordingly, support rods 65 may hold pivot legs 62 at a desired angular position. Wheels 63, affixed to the ends of legs 62, aid in moving the treadmill along the floor or ground.

The embodiment of the invention as illustrated in FIGS. 1 and 2 is used as an exercise treadmill where a runner operates motor 46 to cause endless belt 39 to move across the upper surface of decking 18 of platform structure 16. With each step, the runner lands on endless belt 39 and decking 18 which imparts a downward force to forward connection member 21 and to the springs 36 and shock absorbers 32 as forward roller 22, and platform structure 16 pivots about shaft 13. The spring 36 opposes the downward force proportional to the downward distance of movement of the forward end of the platform structure 16. The shock absorber 32 opposes downward force proportional to the velocity at which the mass is moving. The mass itself opposes the downward force proportional to the acceleration at which it is moving. By proper selection of the mass of the system, the spring constant of the spring 36, and the friction constant of shock absorber 32, a damped response of the treadmill can be achieved in response to the landing force of a runner's foot on belt 39 and platform structure 16. Of course, the treadmill system returns to its original position, with a damped response in the opposite direction when the runner takes another stride.

The result is less impact force on the runner's feet, ankles and limbs, because on landing with the treadmill, his foot meets a yielding surface which moves downwardly with a damped response. In other words, his foot decelerates over a longer time period—determined by the response time constant of the mass, spring constant, and friction constant of the shock absorbers. This longer time period is in contrast to the situation where the runner's foot lands on an unyielding surface, such as concrete pavement, where the deceleration of the runner's foot is much shorter and the shock force of impact is imparted to his foot, ankles and legs.

An advantageous feature of the invention is that the decking 18 of platform structure 16 is maintained in close proximity to the belt while the belt moves or slides freely above decking 18. This proximity of belt 39 and decking 18 prevents the belt 39 from sagging or yielding as the runner's foot lands on the belt 39 and the decking 18 below. A stable running surface, that is, a taught belt with the decking 18 immediately below it, presents a laterally stable running surface for the prevention of turned or twisted feet, ankles or knees of the runner.

Figure 3:
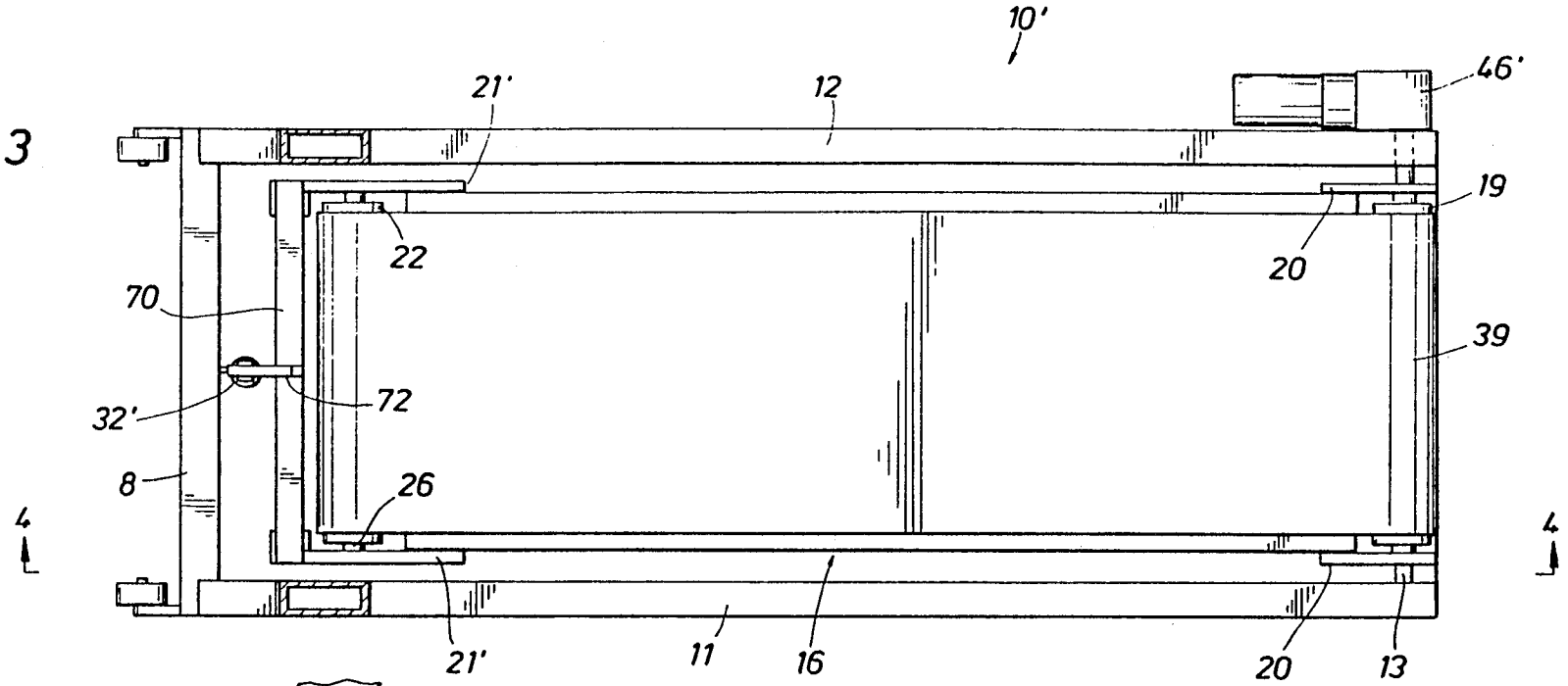
FIG. 3 is a plan view of an alternative treadmill according to the invention incorporating a modified shock absorber/spring system and a treadmill drive system connected to its rear roller.
Figure 4:
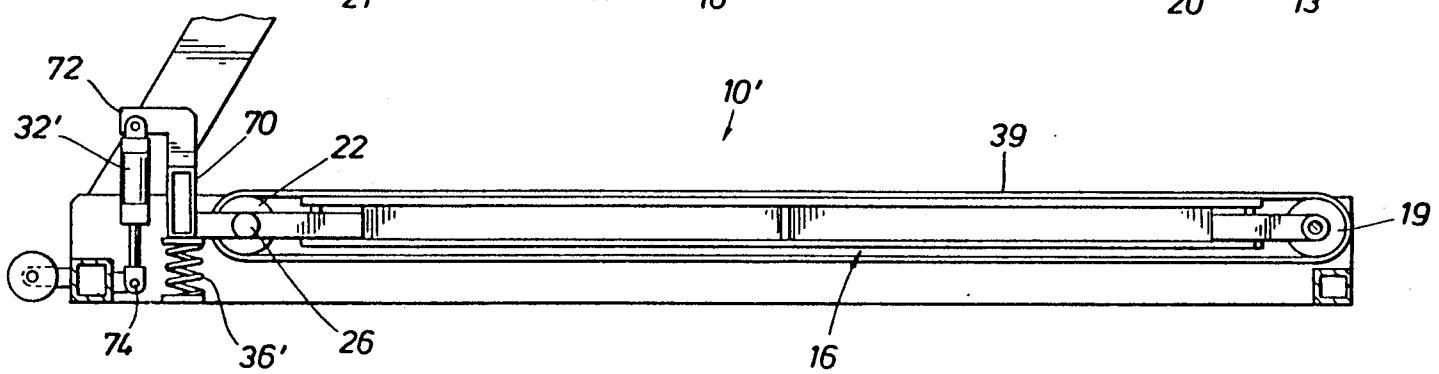
FIG. 4 is a sectional view taken along the line 4—4 of FIG. 3.

An alternative embodiment of the invention incorporating a shock absorbing system is illustrated in FIGS. 3 and 4. In this embodiment, the forward connection members 21' support shaft 26 of forward roller 22 as in the embodiment of FIG. 1, but members 21' are each connected to a cross member 70 which is supported by a single spring 36' (which may be supported by the floor or a connecting member attached to rails 11 or 12 (not shown)). A single shock absorber or damper 32' may be connected to cross member 70 via linkage 72 and to base cross member 8 via linkage 74. The treadmill endless belt 39 may be driven by rear mounted motor 46', the output shaft of which drives shaft 13 to which rear roller 19 is rigidly attached.

FIGS. 5A and 5B show the forward connection member 21 supported by means of an integral unit 80 including spring 82, and shock absorber 84. One or more of such units may be provided as illustrated in FIGS. 1 and 3. Such integral unit 80 includes a cylindrical case filled with a fluid preferably oil 88. A piston 90 has a piston rod 92 attached to it which extends through the upward end of case 86 by way of a suitable seal 94. The upper end of rod 92 is secured to the forward connection member 21 of the treadmill. The piston head 90 includes an orifice 96 extending through it. Another orifice 98 includes a ball check valve 100 which seats during piston 90 movement downward. Such check valve 100 is closed during downward movement. As a result, piston 90 resists downward movement, caused by a force on member 21, at a rate depending on the size of orifice 96. As oil is forced through orifice 96, heat is generated along with a pressure drop which provides the resisting force. When the load of the runner's weight is removed, the compressed spring 82 moves to reposition the piston 90. The ball in the check valve 100 unseats, opening the valve, thus permitting rapid fluid return. A large opening 98 provides only little resistance to upward movement of the piston 90 in returning forward connection 21 to its rest position.

An auxilliary shock absorber 102 is mounted on bracket 104 which is attached to vertical member 40. As the forward connection member 21 pivots back to its rest position by virtue of the restoring force of spring 82, member 21 impacts rod 106 of auxilliary shock absorber 102 bringing member 21 to its rest position with a damped response. Such damping is only operable over a short distance from the rest position of the treadmill platform. In other words, on the return to the rest position, spring 82 acts to rapidly force member 21 and the treadmill to its rest position, so as to restore the treadmill to its rest position in time for another impact of the runner's foot after being in the air above the platform. On the downward stroke in response to the impact of the runner's foot, piston 84 of integral spring/shock absorber 80 introduces damping throughout such stroke.

It should be emphasized that other shock-absorbing structures are known in the art which are primarily uni-directional in nature as that described above and illustrated in FIGS. 5A and 5B. Such single orifice shock absorber provides substantially constant damping throughout its downward stroke.

FIG. 6 is an illustration of spring 110 and shock absorber 108 elements which are discrete and independent of one another, yet are mechanically equivalent to the spring 82, shock absorber 84 of FIGS. 5A and 5B.

FIG. 7 illustrates still another arrangement where spring 114 surrounds the piston rod of shock absorber 112 and bears against member 21 and the top of the case of shock absorber 112.

Figures 8A, 8B, 8C, 8D, 8E:
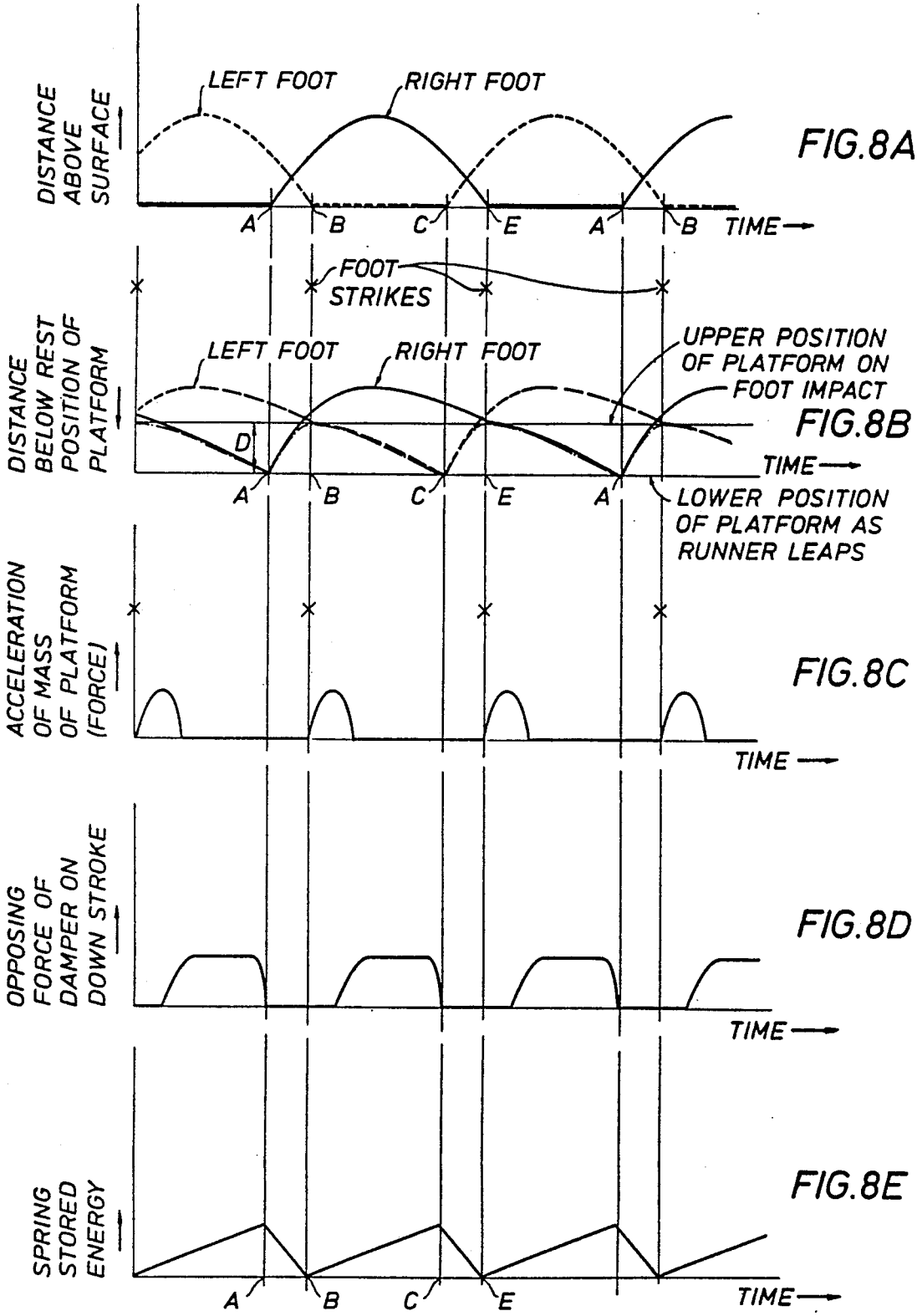
FIGS. 8A through 8E present an idealized model and time response of the treadmill and runner during the downward movement of the treadmill.

FIGS. 8A through 8E illustrate the action of the treadmill according to the invention by a sequence of time diagrams. FIG. 8A illustrates a runner's left foot and right foot as distance above the surface of a prior art rigid platform of a treadmill. As the right foot leaves the surface at time A as the runner strides, the left foot is coming down and hits the surface at time B. All of the impact on the rigid surface is absorbed by the runner's legs. The left foot leaves the surface at time C while the right foot hits the surface at time E. Again, all of the impact of the right foot striking the platform is absorbed by the runner's leg.

FIG. 8B illustrates the action of a runner on the treadmill of the invention described herein. At time A, the right foot of the runner is on the platform of the treadmill at a bottom position which is a distance D below the upper or "rest" position of the platform when no weight of the runner is placed on the platform. As the runner leaps off his right foot at time A, the platform is quickly returned to its upper or "rest" position. Soon thereafter at time B, the left foot impacts the treadmill, and the left foot and the platform descend to the lower position from time B to time C. This descent from time B to time C prevents large impact forces from being absorbed by the runner's left leg. In a similar manner, after the leap by the left foot at time C, the platform again is returned quickly from time C to time E such that it is at its upper or rest position in time for the right foot at time E to impact the platform. The right foot is cushioned on its descent with the platform as it moves to its lower position, and so on.

FIG. 8C illustrates the acceleration of the mass of the platform immediately after each foot strikes the platform. The numerical product of such acceleration times the mass of the platform represents the impact force experienced by each foot as it strikes the platform according to the invention. A platform having minimal mass contributes to the minimization of impact forces on the runner's legs.

FIG. 8D illustrates the opposing force of the uni-directional damper as the platform descends from its upper or rest position to its lower position. The damper delays with its damping force a short time after each foot strike, but is substantially constant during the platform's descent. The uni-directional damper offers substantially no damping force during the upward motion of the platform.

FIG. 8E represents the stored energy of the spring as a function of time where it stores energy from time B to time C on the descent of the platform and applies such energy from time C to time E during the ascent of the platform by forcing it upward to its rest position.

FIGS. 8B-8E, as described above, provide a convenient graphical description of the key features of the invention. The damping function is provided only during the down excursion of the platform, not the up excursion. The runner's speed establishes the cycle time of the treadmill up and down movement. The springs provided at the front of the treadmill store the energy needed to return the platform (and belt, etc.) to the rest position. Providing a low mass platform is important to reduce the impact force on the runner's leg at the moment his foot strikes the platform. Selection of a spring constant of the return spring should be made such that the platform can be quickly returned to rest (e.g., between times A and B and C and E of FIG. 8B), but should not be so great that impact forces are unduly increased on the runner's foot at the moment of the impact. The remaining portion of the cycle time (i.e., between times B and C and between E and A as illustrated in FIG. 8B) should be resisted, primarily by damping on the downward stroke to decelerate the downward excursion to zero velocity. It is desirable that such deceleration occur over as long a percentage of the cycle time as possible.

Figure 9A:
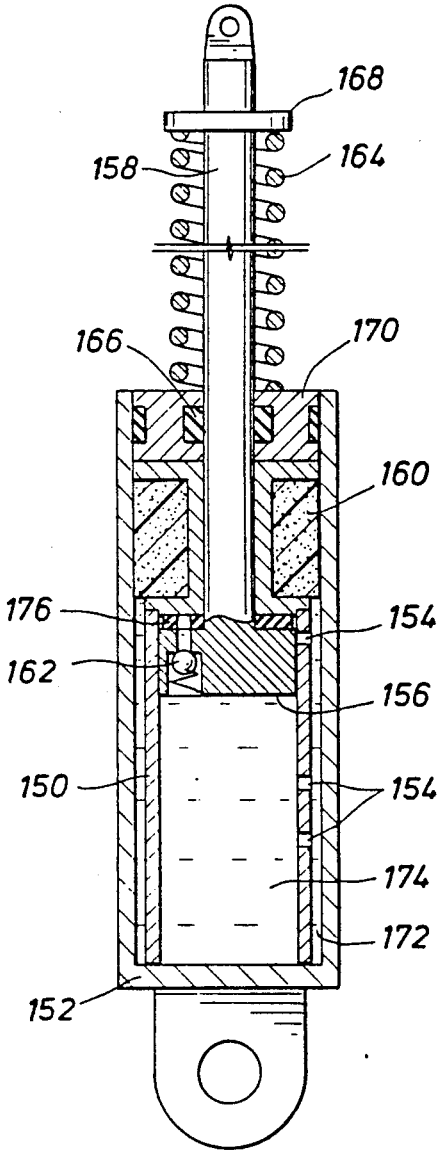
FIGS. 9A and 9B illustrate a progressive damper or shock absorber which may be used with the treadmill of the invention.
Figure 9B:
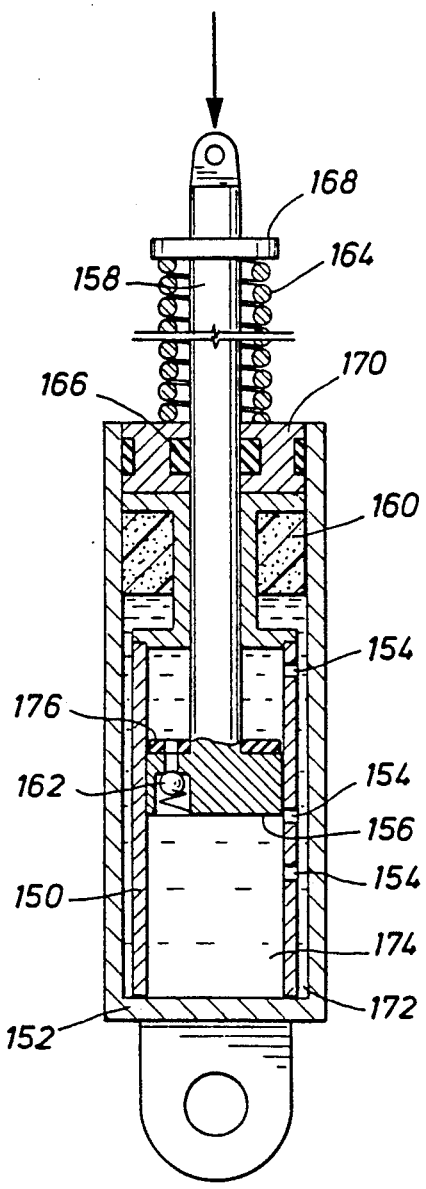

The conventional single orifice shock absorbers of FIGS. 5A, 5B, 6 and 7 may be replaced with a multiple orifice spring and damper as illustrated in FIGS. 9A and 9B. FIGS. 9A and 9B illustrate a double cylinder damper arrangement with space between the concentric inner cylinder 150 and outer cylinder 152, with a series of orifice holes 154 provided along the length of the inner cylinder 150 wall. Oil 174 is provided in inner cylinder 150. A piston head 156, slidably disposed within inner cylinder 150, has a piston rod 158 extending outwardly to a shoulder 168. Spring 164 is disposed about rod 158 between shoulder 168 and end cap 170. A seal 166 seals the rod as it moves in and out through the end cap 170 of the shock absorber. A closed cellular foam accumulator 160 is provided in communication with the annulus 172 between the inner and outer cylinders.

When a force is applied to shoulder 168, as from the front end of platform 21, spring 164 is compressed and rod 158 and piston head 156 are forced into inner cylinder 150. During downward piston movement, oil in inner cylinder 150 is forced through orifices 154, through the annulus 172 to the closed cellular foam accumulator 160 behind the piston head 156.

On the repositioning or upward stroke, spring 164 pulls the piston rod 158 and piston head 156 upward, which opens check valve 162 and permits all the flow from the accumulator 160 back into the interior of inner cylinder 150. Such arrangement of FIGS. 9A and 9B allows a ramp or increasing frictional force as a function of stroke length of piston 156 as contrasted to conventional damping as illustrated in FIG. 8D. In other words, the damper of FIGS. 9A and 9B may be characterized as a progressive damper or shock absorber and spring which allows for deceleration with a gradually increasing or progressive resisting force. Such ramp force versus stroke characteristic provides minimal resistance at the initial impact part of a runner's foot on platform 21 and yet increases gradually as the force of the runner's foot from point B to C or E to A of FIG. 8B is gradually resisted.

FIGS. 9A and 9B further illustrate that an elastomeric pad or plate 176 is provided on the back side of piston head 156 to provide a cushioning effect on rod 164 as the treadmill returns to its rest position. Such pad or plate 176 provides the equivalent function to the damper 102 illustrated in the embodiments of FIGS. 5A, 5B, 6 and 7.

Figure 1A:
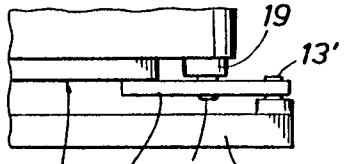
FIG. 1A is a partial plan view of the rear of the treadmill which illustrates the rear of the treadmill being mounted to or carried by a portion of the platform structure which is pivotally mounted to the base of the treadmill.

The description of preferred embodiments of the invention described above should be viewed as illustrative of the invention and not limitative. Minor structural changes from the treadmills illustrated and described above may occur to one skilled in the treadmill art. For example, the support base may be modified such that longitudinal rails 11, 12 are split into forward and rear sections to provide forward and rear support for the platform structure 16 without extending the entire longitudinal distance of the treadmill. The rear roller of the belt system may be carried by the rear platform structure rather than mounted to the support base as illustrated in FIG. 1A mounted to or carried by shaft 13 which may rotated in member 20' of platform structure 16 and which shows member 20' being pivotally supported to shaft 13' carried by base 11. The spring and shock absorber of the front mounting for the platform structure could be connected directly to floor or ground on which the treadmill is placed. Gear drives could be used to drive either the front or rear rollers rather than the preferred belts as illustrated. Accordingly, the only limitations to the invention are incorporated in the claims which follow.

What is claimed is:

1. An exercise treadmill comprising a base, a belt system including forward and rear rollers and an endless belt placed about said rollers, said belt having an upwardly exposed operative section, a belt support platform structure having forward and rear ends, said platform structure at least partially underlying said operative section of said belt and carrying said forward roller of said belt system, supporting means for pivotally supporting said platform to said base near the rear end, shock absorbing platform support means including, spring means for supporting said structure in a rest position when a runner is not on said belt and for storing a portion of the energy imparted to said belt and said belt support platform structure by a runner's foot impacting said belt and returning said belt support platform structure to said rest position as said runner strides from said belt, and damping element means connected between said front end of said belt support platform structure and said base for providing relatively high damping of the downward movement of said platform structure by dissipating a portion of the energy imparted to said belt and said belt support platform structure by a runner's foot impacting said belt, said damping element means offering substantially lower damping to said platform structure when said spring returns said platform structure to said rest position, wherein said front end of said belt support platform structure moves downward with a damped response when a runner's foot impacts said belt.

2. The treadmill of claim 1 further comprising another damping element means arranged to dampen only the final upward movement of said platform structure as it is returned to its rest position by said spring means during the stride of a runner.

3. The treadmill of claim 1 wherein said spring means is a discrete compression spring, and said damping element is a discrete shock absorber which damps movement of said belt support platform structure in the downward direction.

4. The treadmill of claim 1 wherein said spring means and said damping element means are provided in an integral arrangement including a fluid filled cylindrical case, a piston disposed within said case connected to a piston rod extending through one of end of said case, a compression spring disposed in said case between the other end of said case and said piston and transfer means for transferring fluid from one side of said piston to its other side with relatively high resistance to movement in one direction of movement of said piston and relatively low resistance to movement in an opposite direction of movement, and wherein said case and said piston rod are connected between said base and said forward end of said platform structure.

5. The treadmill of claim 1 wherein said damping element means includes a fluid filled cylindrical case, a piston disposed within said case connected to a piston rod extending through one end of said case, and transfer means for transferring fluid from one side of said piston to the other side with relatively high resistance to movement in one direction of movement of said piston and relatively low resistance to movement in an opposite direction of movement, and said spring means is a compression spring disposed about said piston rod, said spring bearing against said one end of said case, and wherein another end of said case and said piston rod and spring are connected between said base and said forward end of said platform structure.

6. The treadmill of claim 5 wherein said damping element means is a single orifice damping device providing substantially constant resisting force to said downward movement of said platform structure.

7. The treadmill of claim 5 wherein said damping element means is a multiple orifice damping device providing an increasing resisting force to said downward movement of said platform structure.

* * * * *